US006907891B2

(12) United States Patent
Anazawa et al.

(10) Patent No.: US 6,907,891 B2
(45) Date of Patent: Jun. 21, 2005

(54) RADIOACTIVE SUBSTANCE DECONTAMINATION METHOD AND APPARATUS

(75) Inventors: Kazumi Anazawa, Hitachi (JP); Motoaki Sakashita, Hitachi (JP); Makoto Nagase, Mito (JP)

(73) Assignees: Hitachi, Ltd., Tokyo (JP); Hitachi Engineering Co., Ltd., Ibaraki (JP)

( * ) Notice: Subject to any disclaimer, the term of this patent is extended or adjusted under 35 U.S.C. 154(b) by 199 days.

(21) Appl. No.: 10/078,347

(22) Filed: Feb. 21, 2002

(65) Prior Publication Data

US 2002/0143224 A1 Oct. 3, 2002

(30) Foreign Application Priority Data

Apr. 3, 2001 (JP) ..... 2001-104079

(51) Int. Cl.[7] ..... G21F 9/28

(52) U.S. Cl. ..... 134/50; 134/84; 134/85; 134/104.4; 588/1; 376/309; 376/310; 976/DIG. 376

(58) Field of Search ..... 588/1, 2, 13; 134/2, 134/3, 10, 26, 28, 50, 84, 85, 104.4; 376/310, 309; 976/DIG. 376

(56) References Cited

U.S. PATENT DOCUMENTS 4,478,060 A 10/1984 Grunewald ..... 68/27
4,690,782 A * 9/1987 Lemmens ..... 252/626
5,386,078 A 1/1995 Hanulik ..... 588/18

FOREIGN PATENT DOCUMENTS

| | | |
|---|---|---|
| CA | 1224025 | 7/1987 |
| JP | 7-253496 | 10/1996 |
| JP | 9-510784 | 10/1997 |
| JP | 2000-105295 | 4/2000 |
| JP | 2000-346988 | 12/2000 |
| JP | 2001-74887 | 3/2001 |
| WO | WO95/26555 | 10/1995 |

* cited by examiner

*Primary Examiner*—Stanley S. Silverman
*Assistant Examiner*—Peter J Lish
(74) *Attorney, Agent, or Firm*—Mattingly, Stanger, Malur & Brundidge, P.C.

(57) ABSTRACT

A radioactive substance decontamination method and apparatus which decontaminates a metal member contaminated by radioactive substance in a short period of time. This apparatus has (1) multiple reducing decontamination tanks having different radiation control values; (2) a carrier for immersing the metal member into the multiple reducing decontamination tanks and a washing tank; (3) a tube for transferring into the second reducing decontamination tank the reducing decontamination agent in the first reducing decontamination tank; (4) a reducing agent decomposer for decomposing a component contained in the reducing decontamination agent of the reducing decontamination tank where the radiation control value is the highest out of the reducing decontamination tanks connected by the tube; and (5) a washing tank for washing the reducing decontamination agent deposited on the decontaminated metal member.

4 Claims, 3 Drawing Sheets

DECON. = DECONTAMINATION

RADIOACTIVE SUBSTANCE DECONTAMINATION METHOD AND APPARATUS

BACKGROUND OF THE INVENTION

1. Field of the Invention

The present invention relates to a radioactive substance decontamination method and radioactive substance decontamination apparatus.

2. Prior Art

Chemical decontamination is a process of removing radioactive substance contained in the oxide film on the surface of an object to be decontaminated by repeating oxidizing and reducing treatment of the object to be decontaminated and by dissolving and removing said oxide film using oxidizing decontamination agent and reducing decontamination agent.

A prior art of chemical decontamination is disclosed in Official Gazette of Japanese Patent Laid-Open NO. 105295/2000 where reducing decontamination is carried out using the reducing decontamination agent containing two or more components whereby the reducing decontamination agent is decomposed. Official Gazette of Japanese Patent Laid-Open NO. 510784/1997 also discloses a method for decomposing an organic acid into carbon dioxide and water using iron complex and ultraviolet ray.

SUMMARY OF THE INVENTION

Problems to be Solved by the Invention

According to the aforementioned prior art, however, oxidizing decontamination, decomposition of oxidizing agent, reducing decontamination and decomposition of reducing agent must be carried out for each cycle. This requires reducing agent to be decomposed for each cycle, and a long time must be spent on chemical decontamination. For example, assume that there are four objects to be decontaminated—from first to fourth objects. Also assume that 2.5 hours are assigned for oxidizing decontamination and decomposition, five hours for reducing decontamination, five hours for decomposition of reducing agent and five hours for washing. Two cycles of operation are considered to be carried out for each object to be decontaminated. In this case, a total of 30 hours are required to pass through the steps of oxidizing decontamination and decomposition, reducing decontamination, decomposition of reducing agent, reducing decontamination, oxidizing decontamination and decomposition, reducing decontamination, decomposition of reducing agent, reducing decontamination and washing. Here decontamination of the second object and thereafter cannot be started before termination of decontamination of the preceding object to be decontaminated. Thus, decontamination of four objects to be decontaminated requires as many as 120 hours.

One of the ways for solving the problem of lengthy treatment time is to increase the size, number or performance of the decontamination agent decomposer, thereby cutting down reducing agent decomposition time. However, increase of the size or number of the decontamination agent decomposers will require the installation space and the circulating flow rate to be increased. In this sense, this solution is not preferred. Further, improvement in the performance of a decontamination apparatus is limited, and the possible advantages of this method are not clear.

Furthermore, when each of oxidizing agent and reducing agent is decomposed in each cycle, oxidizing decontamination or reducing decontamination must be performed by new chemicals in the next step. This requires a great amount of chemicals. For example, when the amount of oxidizing decontamination agent is 3 $m^3$ and 200 ppm of potassium permanganate is used as oxidizing decontamination agent, about 0.6 kg of potassium permanganate is necessary for each cycle. When the amount of reducing decontamination agent is 3 $m^3$, 2000 ppm of oxalic acid is used as reducing decontamination agent and potassium permanganate in oxidizing decontamination agent is decomposed by oxalic acid, about 7.4 kg of oxalic acid is required for each cycle. Accordingly, if one object is to be subjected to two cycles of decontamination, decontamination of four objects will require about 4.8 kg of potassium permanganate, and about 59.2 kg of oxalic acid. One way to reduce the amount of chemical is to reduce chemical concentration, but reduction of chemical concentration will be accompanied by reduced effect of decontamination; so it is difficult to reduce chemical concentration.

Furthermore, metal ion generated by decomposition of oxidizing agent is absorbed by cation resin, with the result that cation resin adsorption is increased. For example, when the surface area of one object to be decontaminated is 40 $m^2$, the amount of oxidizing decontamination agent is 3 $m^3$ and 200 ppm of potassium permanganate is used as oxidizing decontamination agent, then the amounts of adsorption of potassium ion and manganese ion generated by decomposition of oxidizing agent in cation resin account for about 35 percent of the total amount of the cation resin adsorption. One way of solving this problem is to increase the amount of cation resin, but this requires the equipment capacity to be increased. So this solution is not preferred.

When the object to be decontaminated is taken out of the decontamination agent in the decontamination tank, radioactive substance dissolved in decontamination agent will be deposited again on the surface of the metal member, or in other words, re-contamination will occur. One way of solving this problem is to feed decontamination agent to a cation resin column during the period of reducing decontamination, thereby removing radioactive substance in the decontamination agent. This method has been practiced so far. However, radiation concentration in decontamination agent depends on the rate and time of liquid flow to the cation resin column. Actually there is a restriction to the rate of liquid flow to the cation resin column and time of decontamination, so reduction of radiation concentration in the decontamination agent is limited. This makes it difficult to avoid completely re-contamination of an object to be decontaminated. There is a limit to reduction of re-contamination of an object to be decontaminated.

For example, assume that the amount of liquid stored in the decontamination apparatus is 3 $m^3$, the rate of liquid flow to the cation resin column is 3 $m^3$ per hour, the radiation removal efficiency is 80% on the cation resin column, reducing decontamination is carried out for five hours and reducing decontamination is carried out twice. Also assume that 90% of the radioactive substance deposited on the object to be decontaminated is leached in the first reducing decontamination and 10% in the second reducing decontamination. Then about 1.7% of the total leached radioactive substance in the first reducing decontamination remains in the reducing decontamination agent, and about 0.21% of the total leached radioactive substance remains in the reducing decontamination agent in the second reducing decontamination. Then the object to be decontaminated is re-contaminated by the radioactive substance remaining in the second reducing decontamination.

The object of the present invention is to provide a radioactive substance decontamination method and radioactive substance decontamination apparatus which decontaminate the metal member contaminated by radioactive substance in a shorter period of time.

Means for Solving the Problems

An embodiment for achieving the above object comprises:

- multiple reducing decontamination tanks having different radiation control values as the upper limit values for radiation dose of the reducing decontamination agent stored inside;
- a carrier for immersing the aforementioned metal member into the aforementioned multiple reducing decontamination tanks and a washing tank;
- a tube for transferring into the second reducing decontamination tank where the aforementioned radiation control value is the second value which is higher than the aforementioned first value, the reducing decontamination agent in the first reducing decontamination tank where the aforementioned radiation control value is the first value out of the aforementioned multiple reducing decontamination tanks;
- a reducing agent decomposer for decomposing a component contained in the reducing decontamination agent of the reducing decontamination tank where the aforementioned radiation control value is the highest out of the reducing decontamination tanks connected by the aforementioned tube; and
- a washing tank for washing the aforementioned reducing decontamination agent deposited on the aforementioned decontaminated metal member.

This embodiment allows parallel decontamination of multiple metal members in reducing decontamination of metal members through the use of sequential use of multiple decontamination tanks having different radiation control values. In other words, when a metal member having been decontaminated in the first reducing decontamination tank are decontaminated in the second reducing decontamination tank, other metal members can be subjected to reducing decontamination of in the first decontamination tank. This allows a greater number of metal members to be decontaminated within a specified time than when reducing decontamination is carried out in one reducing decontamination tank. This signifies improved working efficiency, and reduced exposure of workers to radiation. Since decontamination can be terminated in a short time, labor cost and equipment operation cost are cut down.

It also allows the reducing decontamination agent in the reducing decontamination tank having lower radiation control value to be transferred into a reducing decontamination tank with higher radiation control value. As a result, reducing decontamination agent cannot be used as reducing decontamination agent of the reducing decontamination tank with a lower radiation control value can be reused in a reducing decontamination tank with higher radiation control value. This makes it possible to reduce the amount of reducing decontamination agent to be used.

Furthermore, since the reducing decontamination agent of the reducing decontamination tank with a lower radiation control value is transferred to the reducing decontamination tank with a higher radiation control value, a device for decomposing reducing decontamination agent need not be installed in the reducing decontamination tank with a lower radiation control value, with the result that the number of reducing decontamination agent decomposers can be reduced, and hence equipment production cost and equipment maintenance cost can be cut down.

DETAILED DESCRIPTION OF THE INVENTION

Description of the Preferred Embodiments

Embodiment 1

Figure 1:
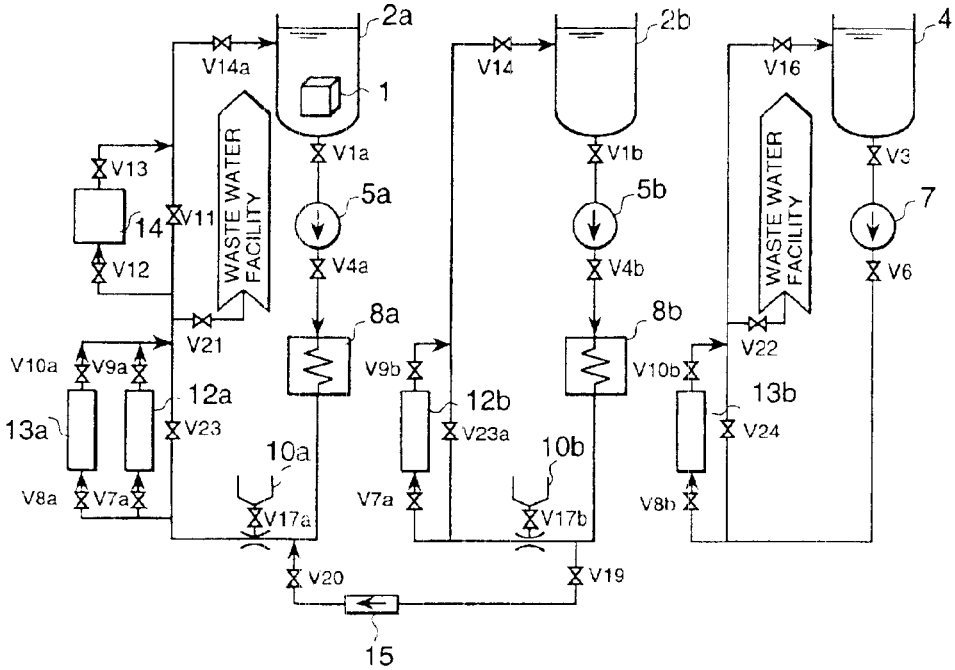
FIG. 1 is a drawing representing the chemical decontamination apparatus of embodiment 1.

FIG. is a drawing representing the schematic configuration of a chemical decontamination apparatus of the present embodiment. This chemical decontamination apparatus comprises reducing decontamination tanks 2*a* and 2*b*, a washing tank 4 and a circulating pipe. The circulating pipe of the reducing decontamination tank 2*a* is provided with a pump 5*a*, heater 8*a*, chemical inlet 10*a*, cation resin column 12*a*, mixed bed resin column 13*a*, reducing agent decomposer 14 and others. The circulating pipe of the reducing decontamination tank 2*b* is equipped with a pump 5*b*, heater 8*b*, chemical inlet 10*b*, cation resin column 12*b* and others. The circulating pipe of the washing tank 4 is provided with a pump 7, mixed bed resin column 13*b*, etc.

Decontamination procedures will be described below:

Firstly, preparation for decontamination is made.

The reducing decontamination tanks 2*a* and 2*b*, and washing tank 4 and circulating pipe thereof are filled with water.

Then the outlet valve V1*a* of the reducing decontamination tank 2*a*, the outlet valve V4*a* of a pump 5*a*, the bypass valve V23*a* of a resin column, the bypass valve V11 of reducing agent decomposer 14, and the return valve V14*a* of reducing decontamination tank 2*a* are opened. While circulating operation is performed by the pump 5*a*, temperature is raised by a heater 8*a* up to a predetermined value. Then valve V17*a* is opened and the reducing decontamination agent is placed from a chemical inlet 10*a* until a predetermined concentration of reducing agent is reached. Then outlet/inlet valves V17*a* and V19*a* of a cation resin column 12*a* are opened, and the bypass valve V23*a* is closed or adjust-closed so that liquid is fed to the cation resin column 12*a* at a predetermined flow rate.

In the same manner as in the case of reducing decontamination tank 2*a* and circulating pipe thereof, the reducing decontamination tank 2*b* and circulating pipe thereof are also adjusted to reach a predetermined concentration of reducing agent, and liquid is fed to the cation resin column 12*b*. For the reducing decontamination tank 2*b* and circulating pipe thereof, it is sufficient that concentration and temperature of reducing agent are adjusted to predetermined values, and preparation for operation of feeding liquid to the cation resin column is completed before an object to be decontaminated 1 is placed in the reducing decontamination tank 2*b*.

The outlet valve V3 of washing tank 4, outlet valve V6 of pump 7, the bypass valve V24 of mixed bed resin column 13*b* and the return valve V16 of washing tank 4 are opened, and the pump 7 is used to start circulating operation. After that, outlet/inlet valves V8*b* and V10*b* of the mixed bed resin column 13*b* are opened, and bypass valve V24 is closed or adjust-closed, liquid is fed to the mixed bed resin column 13*b* at a predetermined flow rate. For the washing tank 4 and circulating pipe thereof, preparation for operation of feeding liquid to the cation resin column is completed before an object to be decontaminated 1 is placed in the washing tank 4.

When preparation has been made for the start of decontamination, an object to be decontaminated 1 is placed in the reducing decontamination tank 2*a*, and is immersed in reducing decontamination agent. Reducing decontamination is carried out while liquid is fed to the cation resin column 12*a*. After the lapse of a predetermined time, the object 1 is taken out of the reducing decontamination tank 2*a*, and is placed in the reducing decontamination tank 2*b*. In the same manner as in the case of the reducing decontamination tank 2*a*, reducing decontamination is carried out. When reducing decontamination is terminated in the reducing decontamination tank 2*b* for a predetermined period of time, the object 1 is moved to a washing tank 4. In the washing tank 4, radioactive substance and reducing decontamination agent is removed from the back of the object 1. Here the circulating pipe of the washing tank 4 is fed to the mixed bed resin column 13*b* by pump 7, and circulating operation is performed. Reducing decontamination agent and radioactive substance fed inside by washing of the object 1 is absorbed and removed by the mixed bed resin column. After washing of the object 1 is completed in the washing tank 4, the object 1 is taken out of the washing tank 4. After the object 1 taken out of the washing tank 4 has been wiped clean of washing water, radiation survey is carried out. Depending on the result of this survey, it is unadsorptioned as a general object, or is put in a waste storage vessel to be stored in safety as radioactive waste.

In the present embodiment, the control value of radiation concentration is higher for the reducing decontamination tank 2*a* and is lower for the reducing decontamination tank 2*b*. If there are many objects to be decontaminated 1, the aforementioned procedure is repeated.

When operation is repeated, there may be a gradual increase of radiation concentration in the reducing decontamination agent with the result that the control value may be exceeded. In this case, reducing decontamination agent in the reducing decontamination tank where radioactive concentration is controlled at the highest value, namely in the reducing decontamination tank 2*a* and circulating pipe thereof in the case of the present embodiment is decomposed and discharged.

Decomposition and discharge procedures are shown below:

Firstly, the outlet/inlet valves V12 and V13 of the reducing agent decomposer 14 is opened and bypass valve V11 is closed (or adjust-closed) so that the liquid is fed to the reducing agent decomposer 14 at a predetermined flow rate and reducing agent is decomposed. If reducing agent has been decomposed until concentration is reduced below a predetermined level, the outlet/inlet valves V8*a* and V10*a* of the mixed bed resin column 13*a* are opened and outlet/inlet valves V7*a* and V9*a* of the cation resin column 12*a* are closed. The bypass valve V23*a* is closed or adjust-closed so that liquid is fed to the mixed bed resin column 13*a* at a predetermined flow rate, and washing is performed. After it has been verified that water quality meets the drainage requirements, the V21 is opened to discharge liquid into drainage equipment so that the reducing decontamination tank 2*a* and circulating pipe thereof are made empty. It should be noted that the pump 5*a* is operated without air being fed inside by the reduction of liquid level in reducing decontamination tank 2*a*, and is then stopped.

Then outlet/inlet valves V19 and V20 of the transfer pump 15*a* are opened to operate the transfer pump 15. Decontamination agent of the reducing decontamination tank where the control value is the second highest, namely, reducing decontamination tank 2*b* in the case of the present embodiment is transferred into the reducing decontamination tank 2*a*. It should be noted that the pump 5*b* is operated without air being fed inside by the reduction of liquid level in the reducing decontamination tank 2*b* and is then stopped.

In the present embodiment, a transfer pump 15 is used to transfer reducing decontamination agent, but a pump 5*b* may be used for this purpose. After that, in the same method as in the case of preparation prior to decontamination, new reducing decontamination agent is replenished in the reducing decontamination tank 2*b* and circulating pipe thereof.

According to the present embodiment, reducing decontamination agent of the reducing decontamination tank where radioactive concentration is controlled at the highest value is decomposed, and decontamination agent of the reducing decontamination tank where radioactive concentration is controlled at the second highest value is transferred into this reducing decontamination tank. This is used as decontamination agent of the reducing decontamination tank where radioactive concentration is controlled at the highest level. This method consumes a smaller amount of decontamination agent as compared to the case where decontamination agent in the reducing decontamination tank where radioactive concentration is controlled at the second highest level are replaced and decomposed, when radioactive concentration of decontamination agent in the reducing decontamination tank where radioactive concentration is controlled at the second highest level has reached the control value. Thus, this method according to the present embodiment reduces the amount of decontamination agent to be discarded, and cuts down chemical decontamination costs.

Embodiment 2

FIG. 1 shows the configuration of the present invention. This embodiment uses the step of oxidizing decontamination in addition to reducing decontamination to enhance the effect of decontamination. An oxidizing decontamination tank 3*a* and circulating pipe thereof are added to the configuration of embodiment 1. The circulating pipe of the oxidizing decontamination tank 3*a* are provided with a pump 6*a*, heater 9*a* and chemical inlet 11*a*.

Firstly, the following describes the preparation for operation:

The outlet valve V2*a* of oxidizing decontamination tank 3*a*, the outlet valve V5*a* of pump 6*a* and the return valve V15*a* of oxidizing decontamination tank 3*a* are opened. While circulating operation is performed using the pump 6*a*, temperature is raised to a predetermined level by a heater 9*a*. Then valve V18*a* is opened and oxidizing decontamination agent is supplied from the chemical inlet 11*a* until a predetermined concentration of oxidizing agent is reached. For the oxidizing decontamination tank 3*a* and circulating pipe thereof, it is sufficient that concentration and temperature of oxidizing agent are adjusted to predetermined values, and preparation for operation is completed before the object to be decontaminated 1 is placed in the oxidizing decontamination tank 3*a*.

In this embodiment, decontamination is carried out in the sequence of reducing decontamination in the reducing decontamination tank 2*a*, oxidizing decontamination in the oxidizing decontamination tank 3*a* and reducing decontamination in the reducing decontamination tank 2*b*. This step is followed by washing in the washing tank 4, and decontamination is terminated. Further description will be omitted to avoid duplication since decontamination procedure is the same as that of embodiment 1 except that the step of oxidizing decontamination is added.

In the present embodiment, decomposition of oxidizing decontamination agent is performed by mixing between reducing decontamination agent and oxidizing decontamination agent. In other words, the pump 6*a* is stopped to suspend circulating operation of the oxidizing decontamination tank 3*a*. Further, the bypass valve V23*a* of the resin column and the bypass valve V11 of the reducing agent decomposer 14 are opened, and the outlet/inlet valves V7*a*, V8*a*, V9*a* and V19*a* of the resin column and the outlet/inlet valves V12 and V13 of the reducing agent decomposer 14 are closed to perform circulating operation. Then the valve V22*a* installed on the pipe connecting between the reducing decontamination tank 2*a* and oxidizing decontamination tank 3*a* is opened; then the valve 21*a* installed on the pipe connecting between the inlet sides of pumps 5*a* and 6*a* is opened. Thus, the reducing decontamination agent and oxidizing decontamination agent are simultaneously sucked inside by the pump 5*a*, and reducing decontamination agent and oxidizing decontamination agent are mixed with each other. The liquid mixture is fed back to the reducing decontamination tank 2*a* through a heater 8*a*. The liquid mixture having returned to the reducing decontamination tank 2*a* is fed back to the oxidizing decontamination tank 3*a* through valve 22*a*. Upon termination of decomposition of the oxidizing decontamination agent, the outlet/inlet valves V7*a* and V9*a* of the cation resin column are opened and the V23*a* is closed to adjust-closed so that liquid mixture is fed to the cation resin column 12*a* at a predetermined flow rate. The metal ion component having generated by decomposition of oxidizing decontamination agent is sucked by the cation resin column 12*a* and is removed.

When oxidizing decontamination agent is decomposed, oxidizing decontamination agent is mixed with reducing decontamination agent and liquid mixture subsequent to decomposition of oxidizing decontamination agent is fed to the cation resin column 12*a*.

The present embodiment provides the same effect as that of the embodiment 1. Further, the effect of decontamination can be improved by reducing decontamination and oxidizing decontamination.

Embodiment 3

Figure 2:
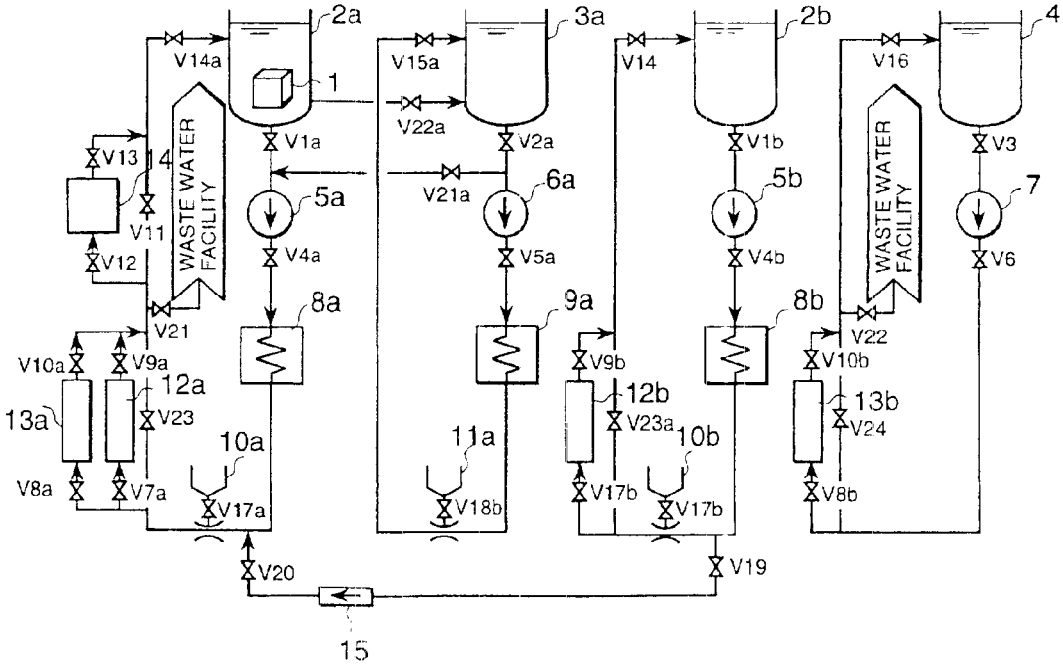
FIG. 2 is a drawing representing the chemical decontamination apparatus of embodiment 2.
Figure 3:
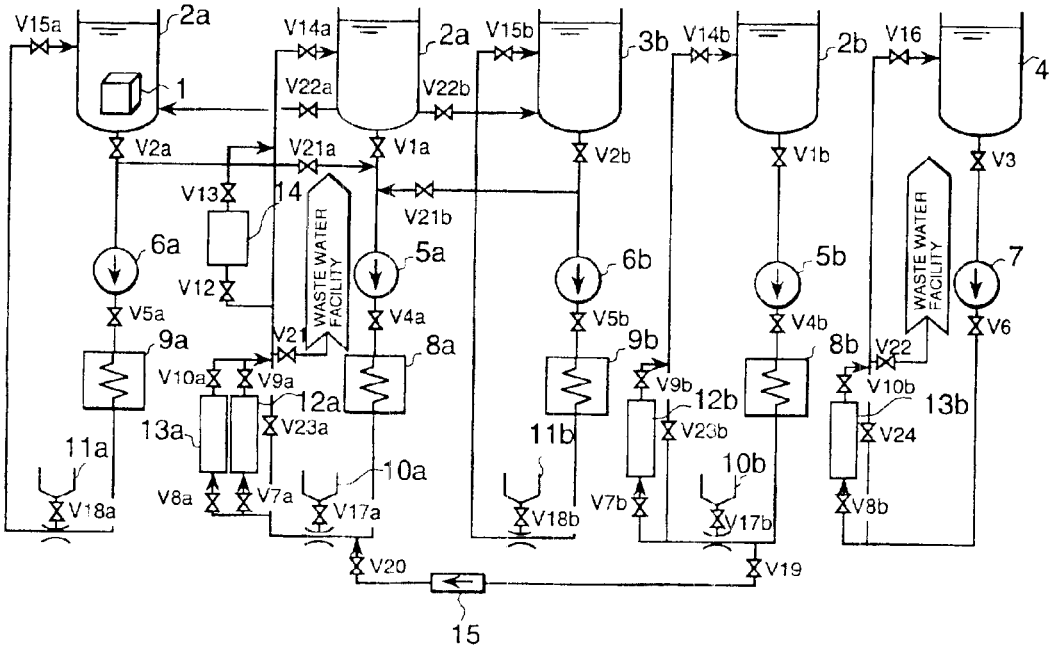
FIG. 3 is a drawing representing the chemical decontamination apparatus of embodiment 3.

FIG. 1 shows the configuration of this embodiment. In this embodiment, the oxidizing decontamination tank 3*b* and circulating pipe thereof are added to the configuration of FIG. 2 to ensure that washing is carried out after oxidizing decontamination and reducing decontamination have each been carried out twice. The circulating pipe of the oxidizing decontamination tank 3*b* has the same configuration as that of the circulating pipe of the oxidizing decontamination tank 3*a*. A predetermined concentration and temperature of oxidizing agent are provided in the oxidizing decontamination tank 3*b* and circulating pipe thereof in the same manner as in the case of FIG. 2. Duplicated description will be omitted since the operation procedure is the same as that of the embodiments 1 and 2 except that the operation is started from the oxidizing decontamination.

Figure 5:
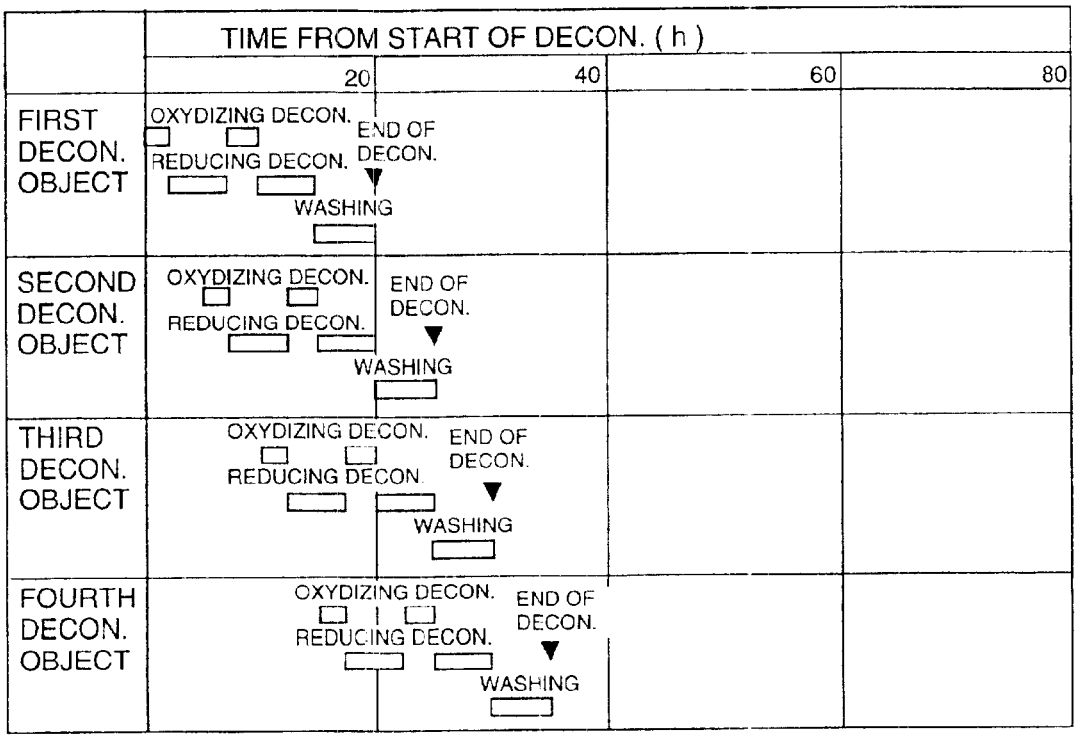
FIG. 5 is a drawing representing decontamination time.

The following describes the procedure of decontamination carried out in the order of oxidizing decontamination, reducing decontamination, oxidizing decontamination, reducing decontamination and washing in this embodiment. Assuming that 2.5 hours are required for oxidizing decontamination, five hours for reducing decontamination and five hour for washing, then 20 hours are required to decontaminate the object 1, as shown in FIG. 5. If there are multiple objects to be decontaminated, 2.5 hours after the first object is moved to the reducing decontamination tank 2*a*, the next object can be decontaminated in the oxidizing decontamination tank 3*a* to start oxidizing decontamination. This allows these operations to be performed in parallel, and decontamination can be completed every five hours. This means that decontamination speed is six times as fast as that in the prior art example.

Further, decontamination is possible without oxidizing decontamination agent and reducing decontamination agent being decomposed, and this provides a substantial reduction of the chemicals used. For example, when the amount of oxidizing decontamination agent is 3 $m^3$ and 200 ppm of potassium permanganate is used as oxidizing decontamination agent, then about 0.6 kg of potassium permanganate will be required for each oxidizing decontamination tank. Further, when the amount of reducing decontamination agent is 3 $m^3$, and 2000 ppm of oxalic acid is used as reducing decontamination agent, about 6 kg of oxalic acid is required for each reducing decontamination tank. According to the experience, the consumption of decontamination agent is reduced to 10% or less by oxidizing decontamination and reducing decontamination, so 10% of both oxidizing agent and reducing agent are replenished in each cycle. Assume that one object is subjected to two cycles of decontamination, then about 1.6 kg of potassium permanganate and about 15.6 kg of oxalic acid are sufficient to decontaminate four objects. Namely, oxidizing agent required in the present embodiment is only 33% that required in the prior art method, and reducing agent required in the present embodiment is only 26% that of the prior art method. This is a substantial reduction in the amount of chemicals to be used. It should be noted that the effect in reducing the amount of chemicals is increased with the number of objects to be decontaminated.

Further, oxidizing agent need not be decomposed during the period of decontamination, so metal ion generated by decomposition of oxidizing agent need not be absorbed and removed by the cation resin, with the result that cation resin adsorption is decreased. For example, 200 ppm of potassium permanganate is used as an oxidizing decontamination agent, and 10% potassium permanganate is replenished in each cycle. Upon decomposition of four objects, the oxidizing agent is decomposed and the manganese ion and potassium ion resulting from decomposition are absorbed and removed by cation resin. If the surface area of one object to be decontaminated is 40 $m^2$, and the amount of oxidizing decontamination agent is 3 $m^3$, then the amount of adsorption of potassium ion and manganese ion generated by decomposition of oxidizing agent in the cation resin can be reduced to about 11% of the total adsorption amount of cation resin. This is a substantial reduction in the adsorption of resin as compared to the percentage of the prior art. It should be noted that the effect in reducing the amount of chemicals is increased with the number of objects to be decontaminated.

In the present embodiment, the radioactive concentration of the reducing decontamination tank 2*a* is controlled at a higher value, and that of reducing decontamination tank 2*b* is controlled at a lower value. So when the relevant object to be decontaminated is taken out of the decontamination agent of the reducing decontamination tank 2*b*, it is possible to reduce the possibility of re-contamination caused by re-deposition of radioactive substance leached in the decontamination agent on the object to be decontaminated. For example, assume that the amount of liquid held in the decontamination apparatus is 3 $m^3$, the rate of liquid flow to cation resin column is 3 $m^3$ per hour, the efficiency of removing radiation on the cation resin column is 80%, five hours is required for reducing decontamination, and reducing decontamination is performed twice. Also assume that 90% of the radioactive substance deposited on the object to be decontaminated is leached out in the reducing decontamination tank 2*a*, and 10% is leached in the reducing decontamination tank 2*b*. In the reducing decontamination tank 2*a*, about 1.7% of the total amount of leeched radioactive substance remains in the reducing decontamination agent. In the reducing decontamination tank 2*b*, about 0.18% of the total amount of leached radioactive substance remains in the reducing decontamination agent. Re-contamination of the object depends on the radioactive concentration in the reducing decontamination tank 2*b*, so the possibility of re-contamination is reduced about 14% as compared to the case in the conventional method.

In embodiments 1 through 3, the circulating pipes of the reducing decontamination tank and oxidizing decontamination tank are each provided with chemical inlets. These inlets are not always necessary. If reducing agent or oxidizing agent can be supplied into the reducing decontamination tank, oxidizing decontamination tank and pipe thereof, the requirements are achieved. One or more chemical adsorptioners may be used to supply reducing agent or oxidizing agent.

Embodiment 4

Figure 4:
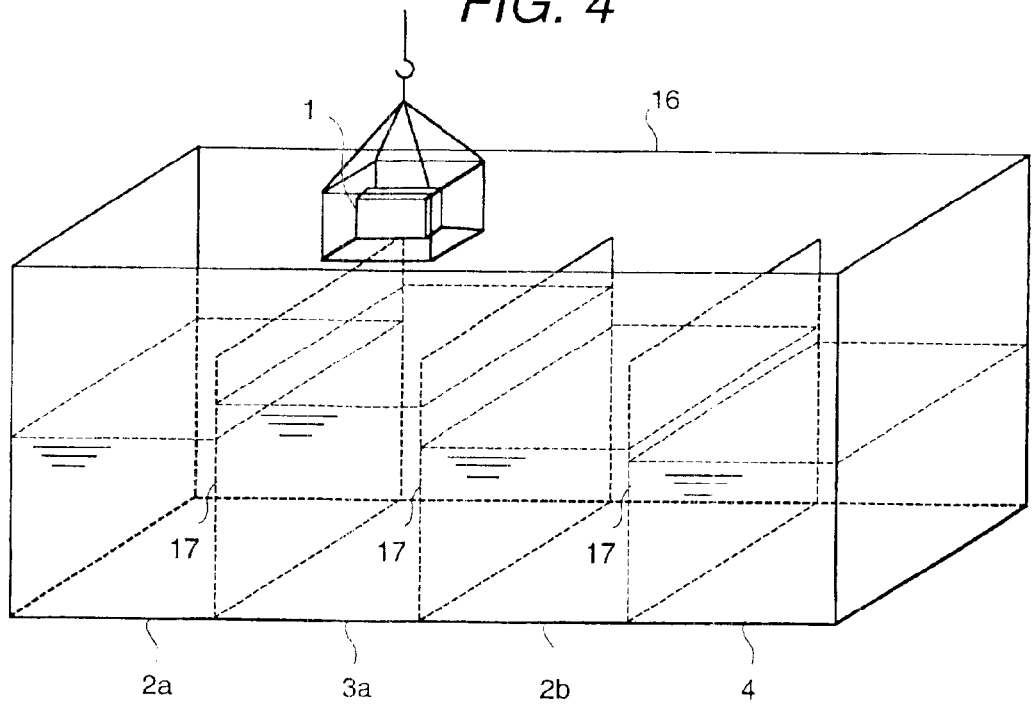
FIG. 4 is a drawing representing the configuration of a decontamination tank.

FIG. 1 shows a decontamination tank according to the present embodiment. Installation of each of the reducing decontamination tank, oxidizing decontamination tank and washing tank is indicated in embodiments 1 through 3. It is also possible to use an arrangement where one tank is separated by a partition plate 17, as shown in this embodiment (FIG. 4). The reducing decontamination agent level, oxidizing decontamination agent level and washing water level must be lower than the partition plate 17, and overflow must not occur when an object to be decontaminated 1 is installed. A crane is used to move the object 1 between tanks. The object to be decontaminated 1 is put in a basket, and the basket is moved between tanks by that crane. More than one object may be placed in the basket.

When the object to be decontaminated 1 is moved, the crane is used to it above the decontamination agent, and remove decontamination agent in this state.

When liquid is removed, a shower with pure water, air blower, wiping means or mechanical polishing means is used to remove radioactive substances deposited on the object 1. This reduces the amount of radioactive substances to be brought into the next tank, thereby improving the effect of decontamination.

A protective barrier 16 is installed within the traveling range of the object to be decontaminated 1. This prevents the decontamination agent from dripping on an uncontrolled position when the object to be decontaminated 1 is moved.

A gutter for recovering the dripping liquid or a protective cover for covering the entire tank may be used instead of installing a protective barrier 16. A combination of the aforementioned methods is also acceptable. This procedure prevents the decontamination agent from dripping on an uncontrolled position.

According to the aforementioned embodiments, use of a smaller amount of decontamination chemicals allows chemical removal of radioactive substances from the surfaces of multiple objects contaminated by radioactive substance. Further, use of multiple decontamination tanks allows multiple objects be decontaminated in a shorter period time.

Effects of the Invention

The present invention provides a radioactive substance decontamination method and radioactive substance decontamination apparatus which ensures decontamination of metal members contaminated by radioactive substances in a shorter period of time.

What is claimed is:

1. A radioactive substance decontamination apparatus for decontaminating a metal member contaminated by a radioactive substance using a reducing decontamination agent, comprising:

multiple reducing decontamination tanks having different radiation control values as upper limit values for a radiation dose of a reducing decontamination agent stored inside, said multiple reducing decontamination tanks including a first reducing decontamination tank and a second reducing decontamination tank;

wherein said second reducing decontamination tank has a radiation control value that is higher than that of said first reducing decontamination tank;

a carrier for taking out said metal member from said second reducing decontamination tank and placing said metal member in said first reducing decontamination tank;

a tube for transferring the reducing decontamination agent in the first reducing decontamination tank into the second reducing decontamination tank;

a first reducing agent decomposer for decomposing a component contained in the reducing decontamination agent of the reducing decontamination tank where said radiation control value is the highest out of the reducing decontamination tanks connected by said tube;

a washing tank for washing said reducing decontamination agent deposited on said decontaminated metal member; and a second reducing decontamination agent decomposer for decomposing reducing decontamination agent in a reducing decontamination tank to which said tube is not connected.

2. A radioactive substance decontamination apparatus for decontaminating a metal member contaminated by a radioactive substance using a reducing decontamination agent, comprising:

multiple reducing decontamination tanks having different radiation control values as upper limit values for a radiation dose of a reducing decontamination agent stored inside, said multiple reducing decontamination tanks including a first reducing decontamination tank and a second reducing decontamination tank;

wherein said second reducing decontamination tank has a radiation control value that is higher than that of said first reducing decontamination tank;

a carrier for taking out said metal member from said second reducing decontamination tank and placing said metal member in said first reducing decontamination tank;

a tube for transferring the reducing decontamination agent in the first reducing decontamination tank into the second reducing decontamination tank;

a first reducing agent decomposer for decomposing a component contained in the reducing decontamination agent of the reducing decontamination tank where said radiation control value is the highest out of the reducing decontamination tanks connected by said tube; and a washing tank for washing said reducing decontamination agent deposited on said decontaminated metal member;

further characterized in that:

said carrier is designed to carry multiple said metal members, and, when carrying said metal members one by one, it immerses the second metal member in a tank other than the one where the first metal member is immersed.

3. A radioactive substance decontamination apparatus for decontaminating a metal member contaminated by a radioactive substance using a reducing decontamination agent, comprising:

multiple reducing decontamination tanks having different radiation control values as the upper limit values for a radiation dose of a reducing decontamination agent stored inside;

said multiple reducing decontamination tanks including a first reducing decontamination tank and a second reducing decontamination tank, wherein said second reducing decontamination tank has a radiation control value that is higher than that of said first reducing decontamination tank;

a first tube for transferring, into the second reducing decontamination tank where said radiation control value is the second value which is higher than said first value, the reducing decontamination agent in the first reducing decontamination tank where said radiation control value is the first value;

an oxidizing decontamination tank for decontaminating said metal member by using an oxidizing decontamination liquid;

a carrier for transferring said metal member from said second reducing decontamination tank into said oxidizing decontamination tank, and said metal member from said oxidizing decontamination tank into said first reducing decontamination tank;

a reducing agent decomposer for decomposing a component contained in the reducing decontamination agent of the reducing decontamination tank where said radiation control value is the highest out of the reducing decontamination tanks connected by said tubs;

a washing tank for washing said reducing decontamination agent deposited on said decontaminated metal member; and a second tube for transferring an oxidizing decontamination agent from said oxidizing decontamination tank to any of said multiple reducing decontamination tanks.

4. A radioactive substance decontamination apparatus for decontaminating a metal member contaminated by a radioactive substance using a reducing decontamination agent, comprising:

multiple reducing decontamination tanks having different radiation control values as the upper limit values for a radiation dose of a reducing decontamination agent stored inside;

said multiple reducing decontamination tanks including a first reducing decontamination tank and a second reducing decontamination tank, wherein said second reducing decontamination tank has a radiation control value that is higher than that of said first reducing decontamination tank;

a first tube for transferring, into the second reducing decontamination tank where said radiation control value is the second value which is higher than said first value, the reducing decontamination agent in the first reducing decontamination tank where said radiation control value is the first value;

an oxidizing decontamination tank for decontaminating said metal member by using an oxidizing decontamination liquid;

a carrier for transferring said metal member from said second reducing decontamination tank into said oxidizing decontamination tank, and said metal member from said oxidizing decontamination tank into said first reducing decontamination tank;

a reducing agent decomposer for decomposing a component contained in the reducing decontamination agent of the reducing decontamination tank where said radiation control value is the highest out of the reducing decontamination tanks connected by said tube;

a washing tank for washing said reducing decontamination agent deposited on said decontaminated metal member; and a second tube for transferring an oxidizing decontamination agent from said oxidizing decontamination tank to the reducing decontamination tank where said radiation control value is the highest out of said reducing decontamination tanks.

* * * * *